US009853387B2

(12) United States Patent
Dai et al.

(10) Patent No.: US 9,853,387 B2
(45) Date of Patent: Dec. 26, 2017

(54) ELECTRICAL CONNECTOR HAVING INSULATIVE MEMBERS AND METHOD OF MAKING THE SAME

(71) Applicant: FOXCONN INTERCONNECT TECHNOLOGY LIMITED, Grand Cayman (KY)

(72) Inventors: Hai-Qiong Dai, Xinyang (CN); Jing-Jie Guo, Huaian (CN)

(73) Assignee: FOXCONN INTERCONNECT TECHNOLOGY LMITED, Grand Cayman (KY)

( * ) Notice: Subject to any disclaimer, the term of this patent is extended or adjusted under 35 U.S.C. 154(b) by 205 days.

(21) Appl. No.: 14/603,327

(22) Filed: Jan. 22, 2015

(65) Prior Publication Data

US 2015/0207257 A1 Jul. 23, 2015

(30) Foreign Application Priority Data

Jan. 22, 2014 (CN) ..... 2014 1 0028618

(51) Int. Cl.

| | |
|---|---|
| ***H01R 13/658*** | (2011.01) |
| ***H01R 13/405*** | (2006.01) |
| ***H01R 13/6585*** | (2011.01) |
| ***H01R 13/6581*** | (2011.01) |
| ***H01R 13/6594*** | (2011.01) |

(52) U.S. Cl.

CPC ..... *H01R 13/405* (2013.01); *H01R 13/6581* (2013.01); *H01R 13/6585* (2013.01); *H01R 13/6594* (2013.01); *Y10T 29/4922* (2015.01)

(58) Field of Classification Search

CPC ..... H01R 13/6585; H01R 13/6594; H01R 13/6581

USPC ..... 439/607.27, 607.53, 101, 108

See application file for complete search history.

(56) References Cited

U.S. PATENT DOCUMENTS

| | | | | |
|---|---|---|---|---|
| 6,796,852 | B2 * | 9/2004 | Okamoto | H01R 43/24 439/516 |
| 7,112,087 | B2 | 9/2006 | Tago et al. | |
| 7,682,199 | B2 | 3/2010 | Ahn et al. | |
| 7,758,379 | B2 * | 7/2010 | Chen | H01R 13/6485 439/607.11 |
| 7,959,478 | B2 * | 6/2011 | Chiu | H01R 13/65802 439/885 |

(Continued)

FOREIGN PATENT DOCUMENTS

| | | |
|---|---|---|
| CN | 201656023 | 11/2010 |
| CN | 102122771 A | 7/2011 |

(Continued)

*Primary Examiner* — Felix O Figueroa

(74) *Attorney, Agent, or Firm* — Wei Te Chung; Ming Chieh Chang

(57) ABSTRACT

A electrical connector (100) includes an insulative housing (1), a number of terminals (2), a stiffener (3) and a pair of insulative members (4). The insulative housing includes a tongue portion (11) defining a number of first passageways (111*a*) and two molding holes (115*a*, 115*b*) communicating with the first passageways for accommodating a number of molds. The stiffener is insert molded with the insulative housing and defines two openings (33*a*, 33*b*) communicating with the molding holes. The insulative members cover the openings for sealing the molding holes after removal of the molds.

12 Claims, 6 Drawing Sheets

(56) References Cited

U.S. PATENT DOCUMENTS

| | | | | |
|---|---|---|---|---|
| 8,109,795 | B2 * | 2/2012 | Lin | H01R 13/6461 439/660 |
| 8,657,633 | B2 | 2/2014 | Shindo et al. | |
| 9,178,319 | B2 * | 11/2015 | Little | H01R 13/6585 |
| 9,225,130 | B2 * | 12/2015 | Zhang | H01R 24/62 |
| 9,461,388 | B2 * | 10/2016 | Zhao | H01R 13/6581 |
| 2012/0252281 | A1 | 10/2012 | Hsia | |
| 2014/0065889 | A1 | 3/2014 | Zhang et al. | |
| 2014/0073191 | A1 | 3/2014 | Colahan et al. | |

FOREIGN PATENT DOCUMENTS

| | | |
|---|---|---|
| CN | 201904481 | 7/2011 |
| CN | 202633635 U | 12/2012 |
| CN | 202856004 U | 4/2013 |
| CN | 203103608 | 7/2013 |
| CN | 203180180 U | 9/2013 |
| TW | 234320 | 6/2005 |
| TW | 385114 | 7/2010 |
| TW | M452487 U | 5/2013 |
| TW | 463921 | 10/2013 |

* cited by examiner

ELECTRICAL CONNECTOR HAVING INSULATIVE MEMBERS AND METHOD OF MAKING THE SAME

BACKGROUND OF THE INVENTION

1. Field of the Invention

The present invention relates to an electrical connector, and more particularly to a micro USB (Universal Serial Bus) connector of which the molding holes formed during manufacturing are covered by insulative members for preventing shorting.

2. Description of Related Art

China Utility Model No. 201904481, issued on Jul. 20, 2011, discloses a micro USB connector including an insulative housing having a base portion and a tongue portion extending from the base portion, a plurality of contacts confined by a plurality of molds and insert molded with the insulative housing, a stiffener having a pair of side portions attached to the tongue portion, and a shell shielding the insulative housing. The tongue portion defines a plurality of channels on a lower surface thereof for receiving the contacts and a plurality of molding holes on an upper surface thereof for accommodating the molds.

U.S. Patent Application Publication No. 2014/0065889, published on Mar. 6, 2014, discloses a micro USB connector including an insulative housing having a base portion and a tongue portion, and a plurality of terminals. The tongue portion has a plurality of ribs formed on a lower surface thereof and a plurality of passageways alternating with the ribs. Each rib has a molding hole opened downwardly for accommodating a mold.

U.S. Pat. No. 8,864,526, issued on Oct. 21, 2014, discloses a micro USB connector including an insulative housing having a base portion and a tongue portion, and a plurality of terminals. A lower surface of the tongue portion comprises a plurality of terminal recesses receiving the terminals and a plurality of ribs each defining a cutout for accommodating a mold. An upper surface of the tongue portion defines a plurality of molding holes for accommodating molds. The micro USB connector further comprises a cover rib covering rear portions of the terminal recesses to cover lower surfaces of the terminals in order to minimize plating of the terminals.

The molding holes are exposed outwardly when the molds are removed. When conductive particles fall into the molding holes, it is prone to fire break-out due to shorting.

An improved micro USB connector is desired.

SUMMARY OF THE INVENTION

Accordingly, an object of the present invention is to provide an electrical connector having molding holes covered by insulative members for preventing shorting.

In order to achieve the object set forth, an electrical connector includes an insulative housing, a number of terminals, a stiffener, and a pair of insulative members. The insulative housing includes a tongue portion defining a number of first passageways and two molding holes for accommodating a number of molds. The stiffener is insert molded with the insulative housing and defines two openings communicating with the molding holes. The insulative members cover the openings for sealing the molding holes after removal of the molds.

The first terminals and the stiffener could be confined at predetermined positions precisely by the molds. The molding holes are sealed by the insulative members to prevent conductive particles from falling into the molding holes to cause fire breakout.

Other objects, advantages and novel features of the invention will become more apparent from the following detailed description when taken in conjunction with the accompanying drawings.

DETAILED DESCRIPTION OF THE PREFERRED EMBODIMENT

Figure 1:
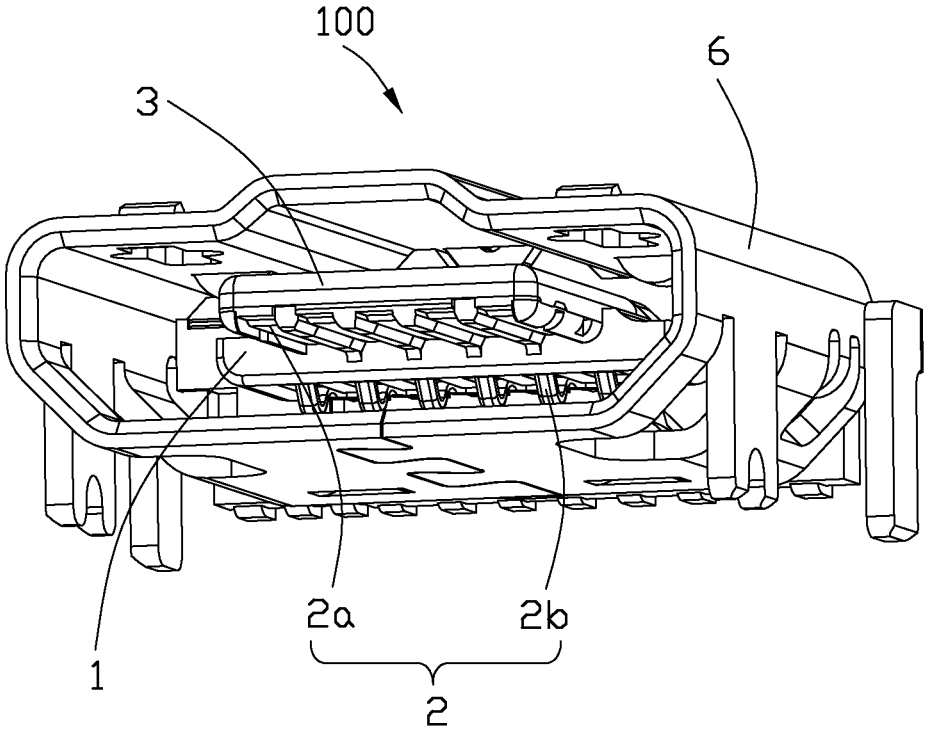
FIG. 1 is an assembled perspective view showing an electrical connector in accordance with the present invention.
Figure 2:
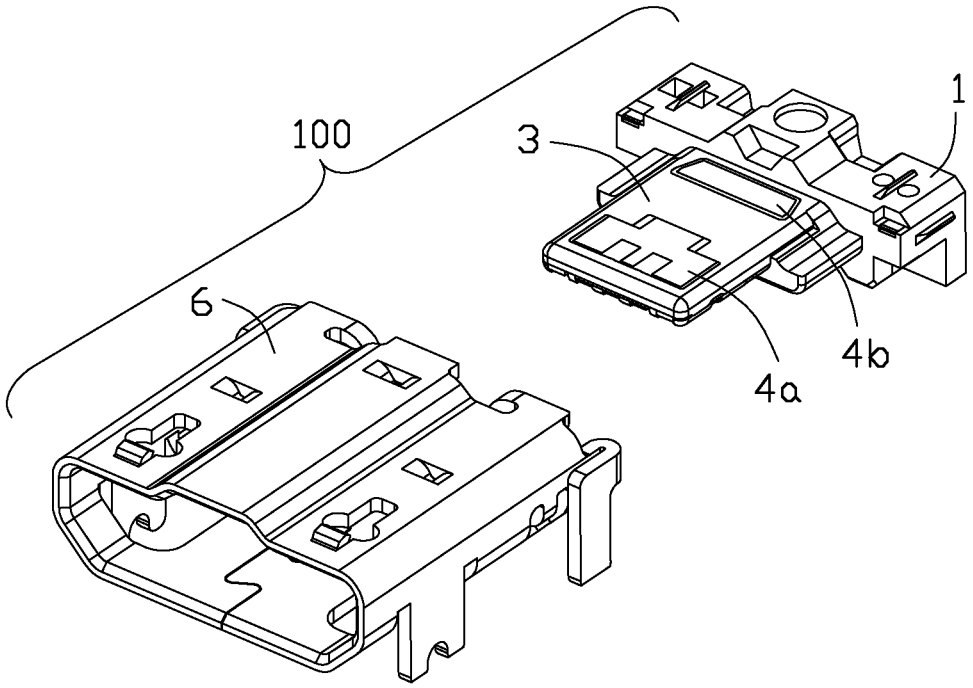
FIG. 2 is a partly exploded perspective view showing the electrical connector shown in FIG. 1, with a shell separated from an insulative housing together with terminals.
Figure 3:
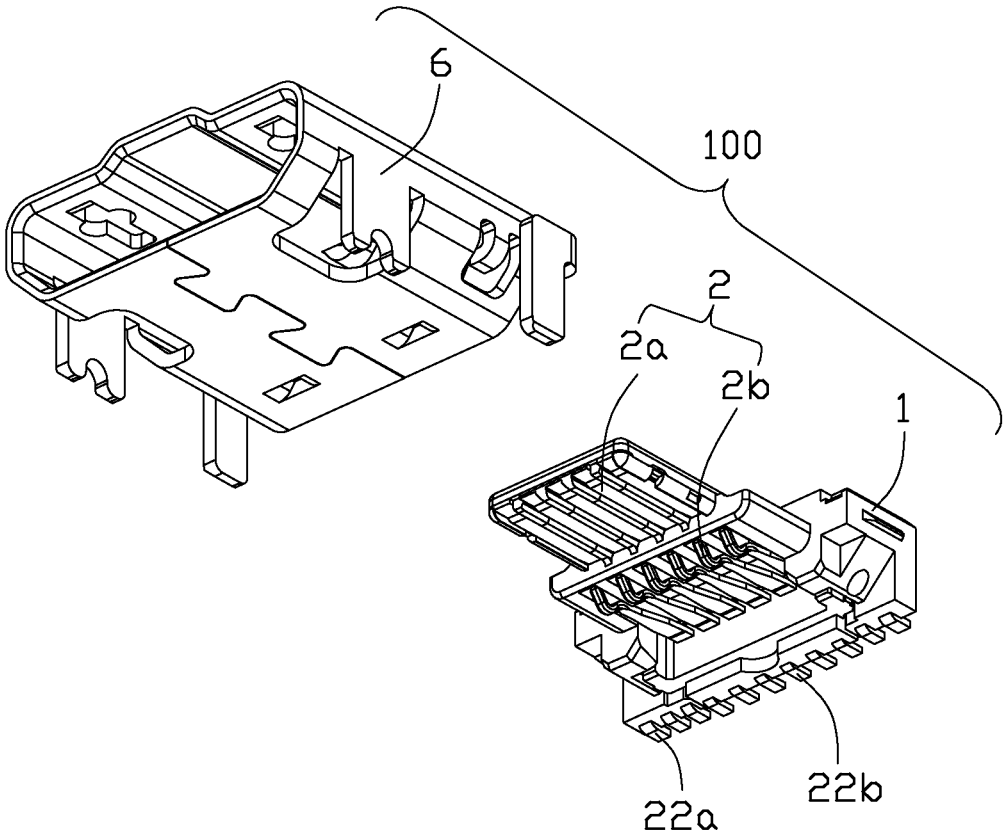
FIG. 3 is another partly exploded view similar to FIG. 2, taken from another aspect.
Figure 4:
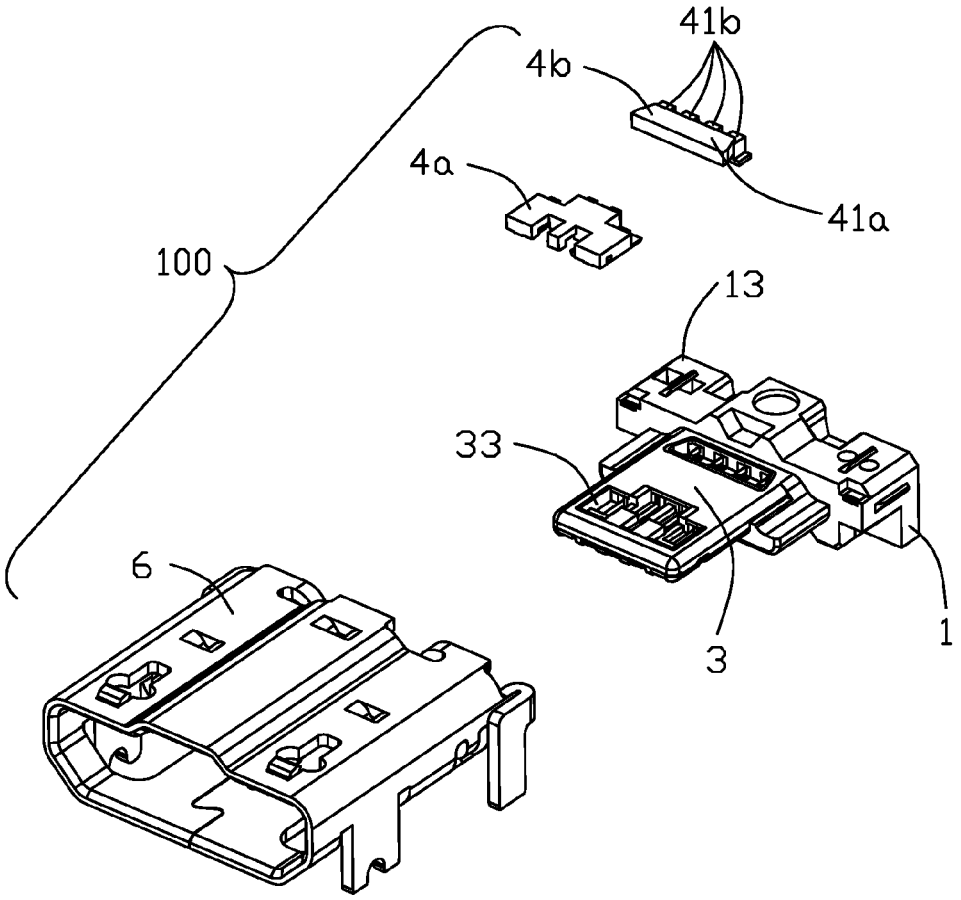
FIG. 4 is a partly exploded view showing the electrical connector shown in FIG. 2, with the shell, a first insulative member, and a second insulative member separated from the insulative housing.
Figure 5:
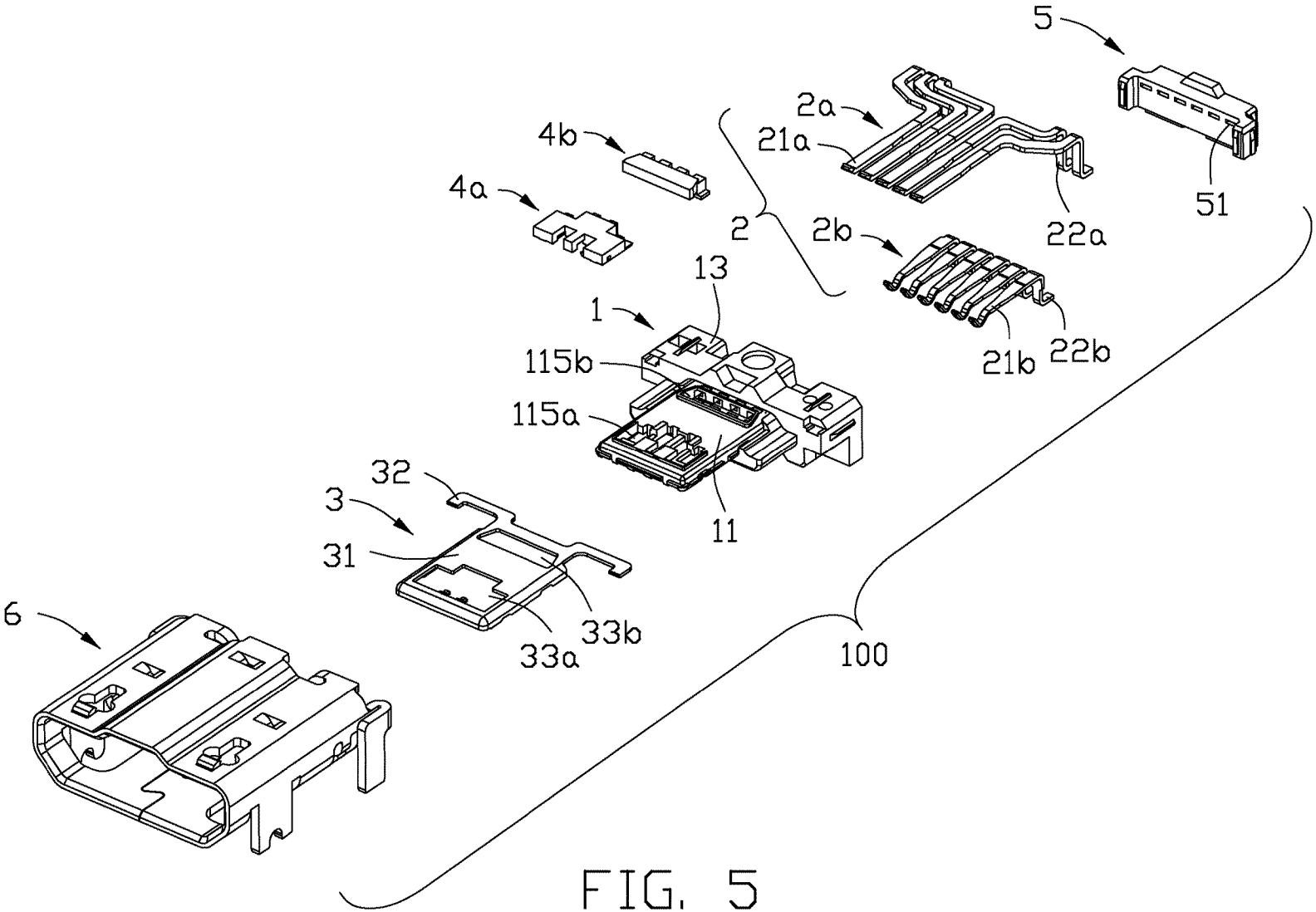
FIG. 5 is an exploded view showing the electrical connector shown in FIG. 1.
Figure 6:
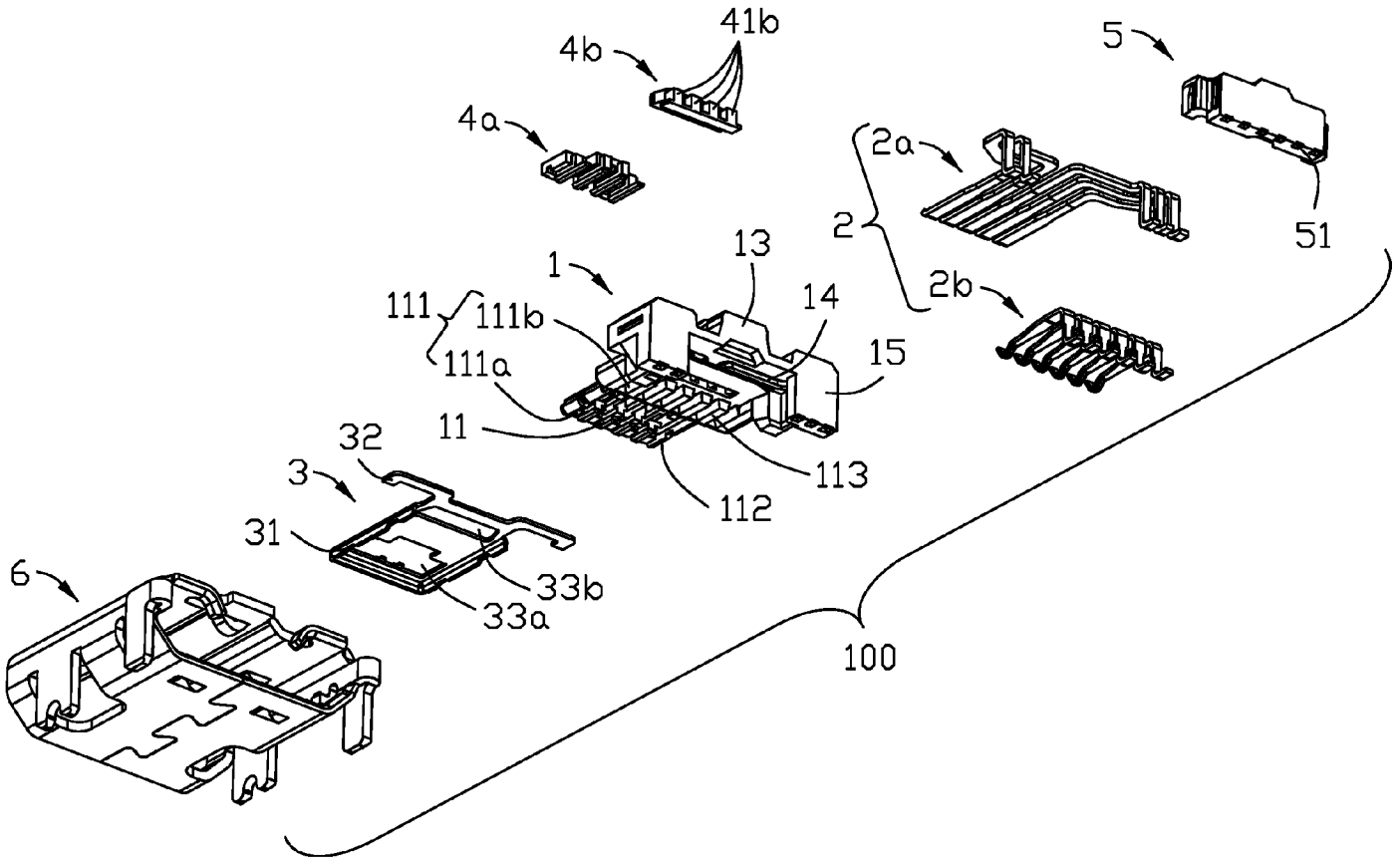
FIG. 6 is another exploded view similar to FIG. 5, taken from another aspect.

Reference will now be made in detail to the preferred embodiment of the present invention. Referring to FIGS. 1-6, an electrical connector 100 comprises an insulative housing 1, a plurality of terminals 2 secured to the insulative housing 1, a stiffener 3 attached to the insulative housing 1, a first insulative member 4*a*, a second insulative member 4*b*, a positioning structure 5 and a shell 6.

An insulative housing 1 includes a base portion 13, a tongue portion 11 extending forwardly from the base portion 13 and defining a plurality of passageways 111, a pair of supporting portions 15 disposed at opposite sides of a rear portion of the base portion 13, and a mounting hole 14 defined between the pair of supporting portions 15. The tongue portion 11 includes a front portion 112 and a rear portion 113. The passageways 111 include a plurality of first passageways 111*a* extending from the front portion 112 to the supporting portions 15, and a plurality of second passageways 111*b* extending along the rear portion 113.

The terminals 2 include a plurality of first terminals 2*a* secured in the first passageways 111*a* and a plurality of second terminals 2*b* secured in the second passageways 111*b*. Each first terminal 2*a* is formed with a flat first contact portion 21*a* and a first soldering portion 22*a*. Each second terminal 2*b* is formed with a curved second contact portion 21*b* and a second soldering portion 22*b*.

The stiffener 3 comprises a body portion 31 attached to the upper portion of the tongue portion 11 and a pair of beams 32 extending laterally from the body portion 31. The body portion 31 defines a first opening 33*a* communicating with a first molding hole 115*a* and a second opening 33*b* rearward the first opening 33*a* and communicating with a second molding hole 115*b*.

The first insulative member 4*a* and the second insulative member 4*b* are made from resin, rubber or other insulative material. The first insulative member 4*a* cover the first opening 33*a* for sealing the first molding hole 115*a*. The second insulative member 4*b* covers the second opening 33*b* for sealing the second molding hole 115*b*. It is noted that the second insulative member 4*b* includes a plurality of rearward projections 41*b* rearwardly projecting into the rear side of the molding hole 115*b* and is unexposed to the exterior in the vertical direction while the block section 41*a* of the insulative member 4*b* is exposed to the exterior in the vertical direction.

The positioning structure 5 defines a plurality of grooves 51 communicating with the second passageways 111*b*.

In assembling of the electrical connector 100, in a first step, punching the plurality of terminals 2 and the stiffener 3 from a metal plate.

In a second step, confining the plurality of terminals 2 in certain positions by a plurality of molds. Insert molding the first terminals 2*a* and stiffener 3 with the insulative housing 1. The first contact portions 21*a* are received in the first passageways 111*a*. The first soldering portions 22*a* extend outwardly from the first passageways 111*a*. The stiffener 3 is attached to a front face of the tongue portion 11.

In a third step, removing the molds to define the plurality of first openings 33*a* and the second openings 33*b* in the stiffener 3 and the first and second molding holes 115*a*, 115*b* in the tongue portion 11. The first and second molding holes 115*a*, 115*b* partially communicate with the first passageways 111*a*. The first molding holes 115*a* communicate with the first openings 33*a* and the second molding holes 115*b* communicate with the second openings 33*b*. Pruning redundant material strip of the metal plate.

In a fourth step, covering, optimally insert molding, the first insulative member 4*a* onto the stiffener 3 to cover the first opening 33*a* for sealing the first molding hole 111*a*, and covering, optimally insert molding, the second insulative member 4*b* onto the stiffener 3 to cover the second opening 33*b* for sealing the second molding hole 111*b*. The second terminals 2*b* are insert molded with the positioning structure 5. The second terminals 2*b* together with the positioning structure 5 is mounted to the insulative housing 1, with the second contact portions 21*b* received in the second passageways 111*b* and the positioning structure 5 received in the mounting hole 14 of the insulative housing 1. Finally enclosing the subassembly into the shell 6.

Optionally, the stiffener 3 could be mounted onto the insulative housing 1 after the first terminals 2*a* insert molded with the insulative housing 1.

The first terminals 2*a* and the stiffener 3 could be confined at predetermined positions precisely by the molds. The first and second molding holes 115*a*, 115*b* are sealed by the insulative members 4*a*, 4*b* to prevent conductive particles from falling into the first and second molding holes 115*a*, 115*b* to cause fire breakout.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing including a base portion and a tongue portion extending forwardly therefrom in a front-to-back direction;

a plurality of immovable terminals embedded within the housing via an insert-molding process, the tongue portion defining a plurality of passageways arranged with one another in a transverse direction perpendicular to said front-to-back direction to receive said immovable terminals therein, and a plurality of molding holes communicating with said passageways in a vertical direction perpendicular to both said front-to-back direction and said transverse direction for receiving corresponding molds during said insert-molding process;

a metallic stiffener embedded in the tongue portion, said stiffener including an opening: and an insulative block including a plurality of parts filled within the corresponding molding holes through the opening of the stiffener; wherein the tongue portion defines opposite surfaces in the vertical direction, and the immovable terminals are exposed upon one surface while the insulative block and the stiffener are exposed upon the other surface.

2. The electrical connector as claimed in claim 1, wherein said insulative block is formed by another molding process.

3. The electrical connector as claimed in claim 1, further including a metallic shell enclosing the housing, and wherein said shell defines a receiving cavity in which the tongue portion extends forwardly.

4. The electrical connector as claimed in claim 1, further including a plurality of deflectable terminals integrally molded within a positioning structure which is attached to the housing, and wherein said deflectable terminals are essentially located behind the immovable terminals in the front-to-back direction.

5. The electrical connector as claimed in claim 1, wherein said molding holes are fully occupied by the insulative block.

6. An electrical connector comprising:

an insulative housing including a base portion and a tongue portion extending forwardly therefrom in a front-to-back direction;

a plurality of immovable terminals embedded within the housing via an insert-molding process, the tongue portion defining a plurality of passageways arranged with one another in a transverse direction perpendicular to said front-to-back direction to receive said immovable terminals therein, and a plurality of molding holes communicating with said passageways in a vertical direction perpendicular to both said front-to-back direction and said transverse direction for receiving corresponding molds during said insert-molding process; and an insulative block including a plurality of parts filled within and completely occupying the corresponding molding holes after the insert-molding process for preventing shorting; wherein both said immovable terminals and said insulative block are exposed to an exterior in the vertical direction while said molding holes are not exposed to the exterior in the vertical direction but covered by the insulative block; and a metallic stiffener embedded within the tongue portion, wherein said stiffener includes an opening set aligning with the molding holes for molding consideration.

7. The electrical connector as claimed in claim 6, wherein said insulative block is formed by another molding process upon the housing.

8. The electrical connector as claimed in claim 7, wherein said insulative block includes a plurality of projections extending into the molding holes along the front-to-back direction and unexposed to the exterior in the vertical direction.

9. The electrical connector as claimed in claim 7, wherein the tongue portion defines opposite surfaces in the vertical direction, and the immovable terminals are exposed upon one surface while the insulative block is exposed upon the other surface.

10. The electrical connector as claimed in claim 6, wherein said stiffener is exposed upon one surface of the mating tongue in the vertical direction.

11. The electrical connector as claimed in claim 6, wherein further including a metallic shell enclosing the housing, wherein said shell defines a receiving cavity in which the tongue portion extends forwardly.

12. The electrical connector as claimed in claim 11, further including a plurality of deflectable terminals integrally molded within a positioning structure which is attached to the housing, wherein said deflectable terminals are essentially located behind the immovable terminals in the front-to-back direction.

* * * * *